US005837164A

United States Patent [19]

Zhao

[11] Patent Number: 5,837,164

[45] Date of Patent: Nov. 17, 1998

[54] HIGH TEMPERATURE PTC DEVICE COMPRISING A CONDUCTIVE POLYMER COMPOSITION

[75] Inventor: Liren Zhao, Mansfield, Ohio

[73] Assignee: Therm-O-Disc, Incorporated, Mansfield, Ohio

[21] Appl. No.: 729,822

[22] Filed: Oct. 8, 1996

[51] Int. Cl.[6] ..... H01B 1/20; H01B 1/22; H01B 1/24; H01C 7/02

[52] U.S. Cl. ..... 252/500; 352/511; 352/512; 338/20; 338/21

[58] Field of Search ..... 252/500, 511, 252/512, 513, 514, 518.1; 524/495; 338/20, 21, 13, 25; 525/420

[56] References Cited

U.S. PATENT DOCUMENTS

| | | | |
|---|---|---|---|
| 4,237,441 | 12/1980 | van Konynenburg et al. | 338/22 |
| 4,238,812 | 12/1980 | Middleman et al. | 361/106 |
| 4,304,987 | 12/1981 | van Konynenburg | 219/553 |
| 4,329,726 | 5/1982 | Middleman et al. | 361/58 |
| 4,420,534 | 12/1983 | Matsui et al. | 428/372 |
| 4,457,973 | 7/1984 | Matsui et al. | 428/372 |
| 4,545,926 | 10/1985 | Fouts, Jr. et al. | 252/511 |
| 4,559,112 | 12/1985 | Tamamura et al. | 204/12 |
| 4,575,620 | 3/1986 | Ishii et al. | 219/549 |
| 4,591,700 | 5/1986 | Sopory | 219/505 |
| 4,624,990 | 11/1986 | Lunk et al. | 525/199 |
| 4,636,331 | 1/1987 | Sako et al. | 252/511 |
| 4,658,121 | 4/1987 | Horsma et al. | 219/553 |
| 4,698,488 | 10/1987 | Kishimoto | 219/549 |
| 4,700,054 | 10/1987 | Triplett et al. | 219/545 |
| 4,742,212 | 5/1988 | Ishii et al. | 219/549 |
| 4,775,778 | 10/1988 | van Konynenburg et al. | 219/549 |
| 4,849,133 | 7/1989 | Yoshida et al. | 252/511 |
| 4,859,836 | 8/1989 | Lunk et al. | 219/548 |
| 4,902,562 | 2/1990 | Bahia | 928/483 |
| 4,910,389 | 3/1990 | Sherman et al. | 219/548 |
| 4,954,695 | 9/1990 | Smith-Johannsen et al. | 219/548 |

(List continued on next page.)

FOREIGN PATENT DOCUMENTS

| | | |
|---|---|---|
| 929 350 | 6/1955 | Germany . |
| 63-302501 | 12/1988 | Japan . |

OTHER PUBLICATIONS

Narkis, M., A. Ram and Z. Stein. Electrical Properties of Carbon Black Filled Crosslinked Polyethylene. Polymer Engineering and Science vol. 21 (16): 1049–1054, Nov. 1981.

Sherman, R.D., L.M. Middleman and S.M. Jacobs. Electron Transport Processes in Conductor–Filled Polymers. Polymer Engineering and Science vol. 23 (1): 36–46, 1983.

Kulwicki, Bernard M. Trends in PTC Resistor Technology. Sample J. (Nov./Dec. 1987): 34–38.

Shrout, T.R., D. Moffatt, W. Huebner. Composite PTCR thermistors utilizing conducting borides, silicides, and carbide powders. J. Material Sci. 26 (1991): 145–154 (No Month).

Ki Hyun Yoon, Yun Woo Nam. Positive termperature coefficient of resistance effects in $BaPbO_3$/polyethylene composites. J. Material Sci. 27 (1992): 4051–4055 (No Month).

Wentao Jia and Xinfang Chen. PTC Effect of Polymer Blends Filled with Carbon Black. J. Appl. Polym. Sci. 54 (1994): 1219–1221 (No Month).

(List continued on next page.)

*Primary Examiner*—Mark Kopec
*Attorney, Agent, or Firm*—Jones, Day, Reavis & Pogue

[57] ABSTRACT

The present invention provides a high temperature PTC device comprising a conductive polymeric composition that exhibits a switching temperature that falls between 150° C. and 190° C., a PTC effect of at least $10^3$ and a low initial resistivity at 25° C. of 10 Ωcm or less. The conductive polymeric composition comprises a semicrystalline polymer component selected from nylon-12 or nylon-11, and a particulate conductive filler. The composition may include, in addition to the nylon-12 or nylon-11, a second semicrystalline component that preferably is a polyolefin-based or polyester-based thermoplastic elastomer. Crosslinking of the composition enhances thermal and electrical stability.

43 Claims, 6 Drawing Sheets

U.S. PATENT DOCUMENTS

| | | | |
|---|---|---|---|
| 5,039,844 | 8/1991 | Nagahori | 219/541 |
| 5,049,852 | 9/1991 | Evans | 219/541 |
| 5,093,898 | 3/1992 | van Konynenburg et al. | 392/451 |
| 5,143,649 | 9/1992 | Blackledge et al. | 252/511 |
| 5,164,133 | 11/1992 | Ishida et al. | 264/103 |
| 5,174,924 | 12/1992 | Yamada et al. | 252/511 |
| 5,178,797 | 1/1993 | Evans | 252/508 |
| 5,227,946 | 7/1993 | Jacobs et al. | 361/106 |
| 5,231,371 | 7/1993 | Kobayashi | 338/22 |
| 5,232,631 | 8/1993 | Cao et al. | 252/500 |
| 5,246,627 | 9/1993 | Heeger et al. | 252/500 |
| 5,250,226 | 10/1993 | Oswal | 252/500 |
| 5,250,228 | 10/1993 | Baigrie et al. | 252/511 |
| 5,254,633 | 10/1993 | Han et al. | 525/327.4 |
| 5,317,061 | 5/1994 | Chu et al. | 525/200 |
| 5,318,845 | 6/1994 | Tanaka et al. | 428/373 |
| 5,340,499 | 8/1994 | Kärnä et al. | 254/505 |
| 5,378,407 | 1/1995 | Chandler et al. | 252/513 |
| 5,382,384 | 1/1995 | Baigrie et al. | 252/511 |
| 5,422,462 | 6/1995 | Kishimoto | 219/545 |
| 5,427,855 | 6/1995 | Heeger et al. | 428/401 |
| 5,451,919 | 9/1995 | Chu et al. | 338/22 R |
| 5,491,027 | 2/1996 | Heeger et al. | 428/401 |
| 5,498,372 | 3/1996 | Hedges | 252/511 |

OTHER PUBLICATIONS

Kozake, K., M. Kawaguchi, K. Sato, M. Kuwabara. $BaTiO_3$–based positive temperature coefficient of resistivity ceramics with low resisitivities prepared by the oxalate method. J. Material Sci. 30 (1995): 3395–3400 (No Month).

Huybrechts, B., K. Ishizaki, M. Takata. Review: The positive temperature coefficient of resistivity in *barium titanate*. J. Material Sci. 30 (1995): 2463–2474 (No Month).

HIGH TEMPERATURE PTC DEVICE COMPRISING A CONDUCTIVE POLYMER COMPOSITION

BACKGROUND OF THE INVENTION

Electrical devices comprising conductive polymeric compositions that exhibit a positive temperature coefficient (PTC) effect are well known in electronic industries and have many applications, including their use as constant temperature heaters, thermal sensors, overcurrent regulators and low-power circuit protectors. A typical conductive polymeric PTC composition comprises a matrix of a crystalline or semi-crystalline thermoplastic resin (e.g., polyethylene) or an amorphous thermoset resin (e.g., epoxy resin) containing a dispersion of a conductive filler, such as carbon black, graphite chopped fibers, nickel particles or silver flakes. Some compositions additionally contain non-conductive fillers, such as metal oxides, flame retardants, stabilizers, antioxidants, antiozonants, crosslinking agents and dispersing agents.

At a low temperature (e.g. room temperature), the polymeric PTC composition has a compact structure and resistivity property that provides low resistance to the passage of an electrical current. However, when a PTC device comprising the composition is heated or an overcurrent causes the device to self-heat to a transition temperature, a less ordered polymer structure resulting from a large thermal expansion presents a high resistivity. In electrical PTC devices, for example, this high resistivity limits the load current, leading to circuit shut off. In the context of this invention, $T_s$ is used to denote the "switching" temperature at which the "PTC effect" (a rapid increase in resistivity) takes place. The sharpness of the resistivity change as plotted on a resistance versus temperature curve is denoted as "squareness", i.e. the more vertical the curve at the $T_s$, the smaller is the temperature range over which the resistivity changes from the low to the maximum values. When the device is cooled to the low temperature value, the resistivity will theoretically return to its previous value. However, in practice, the low-temperature resistivity of the polymeric PTC composition may progressively increase as the number of low-high-low temperature cycles increases, an electrical instability effect known as "ratcheting". Crosslinking of a conductive polymer by chemicals or irradiation, or the addition of inorganic fillers or organic additives are usually employed to improve electrical stability.

In the preparation of the conductive PTC polymeric compositions, the processing temperature often exceeds the melting point of the polymer by 20° C. or more, with the result that the polymers may undergo some decomposition or oxidation during the forming process. In addition, some devices exhibit thermal instability at high temperatures and/or high voltages that may result in aging of the polymer. Thus, inorganic fillers and/or antioxidants, etc. may be employed to provide thermal stability.

One of the applications for PTC electrical devices is a self-resettable fuse to protect equipment from damage caused by an over-temperature or over-current surge. Currently available polymeric PTC devices for this type of application are based on conductive materials, such as carbon black filled polyethylene, that have a low $T_s$, i.e. usually less than 125° C. However, for some applications, e.g. circuit protection of components in the engine compartment or other locations of automobiles, it is necessary that the PTC composition be capable of withstanding ambient temperatures as high as 125° C., without changing substantially in resistivity. Thus, for these applications, the use of such a polyethylene-based or similar device is inappropriate. Recent interest in polymeric PTC materials, therefore, has focused on selection of a polymer, copolymer or polymer blend that has a higher and sharper melting point, suitable for comprising a high temperature polymeric PTC composition (i.e. a composition having a $T_s$ higher than 125° C.).

For many circuits, it is also necessary that the PTC device have a very low resistance in order to minimize the impact of the device on the total circuit resistance during normal circuit operation. As a result, it is desirable for the PTC composition comprising the device to have a low resistivity, i.e. 10 ohm-cm (Ωcm) or less, which allows preparation of relatively small, low resistance PTC devices. There is also a demand for protection circuit devices that not only have low resistance but show a high PTC effect (i.e. at least 3 orders of magnitude in resistivity change at $T_s$) resulting in their ability to withstand high power supply voltages. In comparison with low $T_s$ materials, some high temperature polymeric PTC compositions have been shown to exhibit a PTC effect of up to $10^4$ or more. High temperature polymeric PTC compositions also generally have more rapid switching times than low $T_s$ compositions, (i.e. the time required to reduce the electrical current to 50 percent of its initial value at the $T_s$), even at low ambient temperatures. Thus, PTC devices comprising high temperature polymeric PTC materials are desirable because they may be expected to have better performance than low temperature polymeric PTC devices, and also be less dependent on the ambient operating temperature of the application.

High temperature polymeric PTC materials such as homopolymers and copolymers of poly(tetrafluorethylene), poly(hexafluoropropylene) and poly(vinylidene fluoride) (PVDF) or their copolymers and terpolymers with, for example, ethylene or perfluorinated-butyl ethylene, have been investigated as substitutes for polyethylene-based materials to achieve a higher $T_s$. Some of these compositions exhibited a $T_s$ as high as 160°–300° C. and a resistivity change at $T_s$ of up to four orders of magnitude ($10^4$) or more. However, thermal instability and the potential for release of significant amounts of toxic and corrosive hydrogen fluoride if overheating occurs, has restricted these materials from practical consideration for high temperature applications.

A variety of other polymers have been tested to explore PTC characteristics. These polymers include polypropylene, polyvinylchloride, polybutylene, polystyrene, polyamides (such as nylon 6, nylon 8, nylon 6,6, nylon 6,10 and nylon 11), polyacetal, polycarbonate and thermoplastic polyesters, such as poly(butylene terephthalate) and poly(ethylene terephthalate). However, under the conditions reported, none of these polymers exhibited a useful high temperature PTC effect with a low resistivity state of 10 Ωcm or less.

More recently, a novel high temperature polymeric PTC composition comprising a polymer matrix of an amorphous thermoplastic resin (crystallinity less than 15%) and a thermosetting resin (e.g. epoxy) has been described. Because the selected thermoplastic resin and thermoset resin were mutually soluble, the processing temperature was substantially low and depended on the curing temperature of the thermoset resin. The use of a thermoset resin apparently assured sufficient crosslinking and no further crosslinking was employed. However, electrical instability (ratcheting) was still a problem with these compositions.

For the foregoing reasons, there is a need for the development of alternative polymeric PTC compositions, and PTC devices comprising them, that exhibit a high PTC effect at a high $T_s$, have a low initial resistivity, are capable of withstanding high voltages, and exhibit substantial electrical and thermal stability.

SUMMARY OF THE INVENTION

The present invention provides a high temperature PTC device comprising a conductive polymeric composition that exhibits high temperature PTC behavior (a $T_s$ that falls between 150° C. and 190° C.), a high PTC effect (at least $10^3$), and a low initial resistivity (preferably 10 Ωcm or less at 25° C.). In particular, the conductive polymeric composition of the invention comprises a semicrystalline polymer component that comprises nylon-12 or nylon-11, and a particulate conductive filler. The conductive filler may be selected from carbon black, graphite, metal particles, and mixtures of these. Preferably, the composition is crosslinked by chemical means or irradiation to enhance electrical stability and may comprise an inorganic filler and/or an antioxidant to enhance electrical and/or thermal stability.

That the conductive polymeric composition of the invention exhibits such favorable PTC properties is surprising, since it has previously been suggested that polyamides are useful only in compositions having a low $T_s$ (about 125° C. or less) and may exhibit a low PTC effect, e.g., less than $10^1$.

The semicrystalline polymer component of the composition may also comprise a polymer blend containing, in addition to the first polymer, 1%–20% by volume of one or more additional semicrystalline polymers. Preferably, the additional polymer(s) comprises a polyolefin-based or polyester-based thermoplastic elastomer, or mixtures of these.

The high temperature PTC device of the invention comprises the conductive polymeric composition and at least two electrodes which are in electrical contact with the composition to allow an electrical current to pass through the composition under an applied voltage, which may be as high as 70 volts or more.

DETAILED DESCRIPTION OF THE INVENTION

Figure 1:
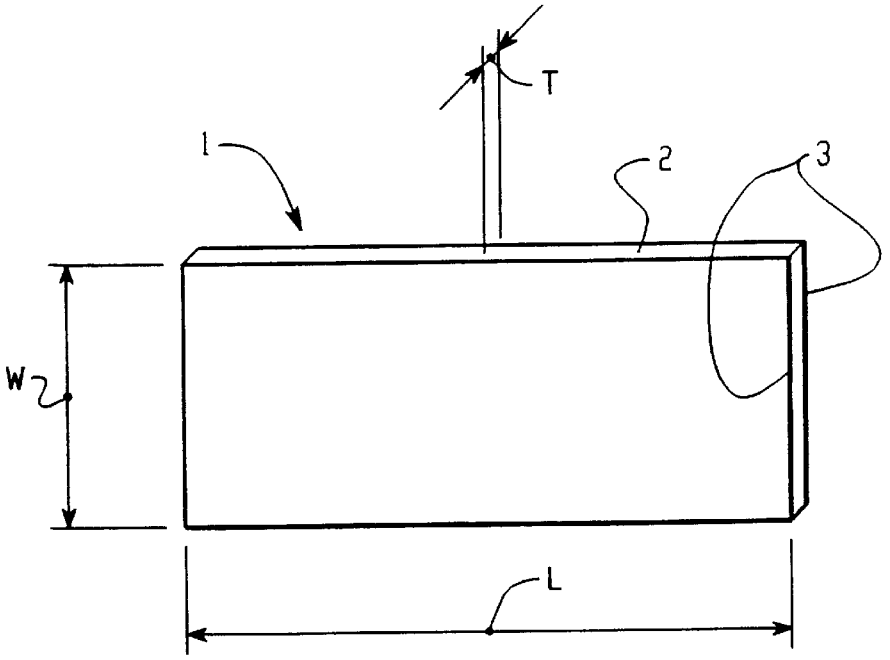
FIG. 1 is a schematic illustration of a PTC chip comprising the polymeric PTC composition of the invention sandwiched between two metal electrodes.

The high temperature polymeric PTC device of the present invention comprises a conductive polymeric composition that demonstrates PTC behavior at a $T_s$ greater than 125° C., preferably between 140° C. and 200° C., and more preferably, between 150° C. and 190° C. The conductive polymeric composition also demonstrates a high PTC effect, i.e. the maximum resistivity, as plotted on a resistivity versus temperature curve, is preferably greater than $10^4$ times, but is at least $10^3$ times, greater than the initial resistivity at 25° C. The preferred polymeric composition exhibits an initial resistivity of 100 Ωcm or less at 25° C., and more preferably 10 Ωcm or less, thus providing for a PTC device having a low resistance of 10 mΩ to 100 mΩ, preferably 15 mΩ to 75 mΩ, with an appropriate geometric design and size, as discussed further below.

The conductive polymeric composition comprising the high PTC device of the invention comprises a polymeric component, which may comprise nylon-12 or nylon-11, or a polymer blend of nylon-12 or nylon-11 with another semicrystalline polymer, preferably a polyolefin-based or polyester-based thermoplastic elastomer. The composition further comprises a particulate conductive filler, as described further below.

It is known that the $T_s$ of a conductive polymeric composition is generally slightly below the melting point ($T_m$) of the polymeric matrix. Therefore, theory predicts that a polymeric PTC composition may exhibit a high $T_s$ if the melting point of the polymer is sufficiently high. If the thermal expansion coefficient of the polymer is also sufficiently high near the $T_m$, a high PTC effect may also occur. Further, it is known that the greater the crystallinity of the polymer, the smaller the temperature range over which the rapid rise in resistivity occurs. Thus, crystalline polymers exhibit more "squareness", or electrical stability, in a resistivity versus temperature curve.

The preferred semicrystalline polymer component in the conductive polymeric composition of the present invention has a crystallinity in the range of 20%–70%, and preferably 25%–60%. In order to achieve a composition with a high $T_s$ and a high PTC effect, it is preferable that the semicrystalline polymer has a melting point ($T_m$) in the temperature range of 150° C. to 200° C., preferably 160°–195° C., and a high thermal expansion coefficient value at a temperature in the range $T_m$ to $T_m$ minus 10° C. that is at least three times greater than the thermal expansion coefficient value at 25° C. Preferably, the polymer substantially withstands decomposition at a processing temperature that is at least 20° C. and preferably less than 40° C. above the $T_m$.

A suitable first polymer for use in the invention comprises nylon-12 obtained from Elf Atochem North America, Inc., Philadelphia, Pa., or EMS American Grilon, Inc., Sumter, S.C., with the commercial names of Aesno-TL and Grilamid L20G, respectively. A nylon-11 polymer suitable for use in the invention may be obtained from Elf Atochem North America, Inc., with the commercial name of Besno-TL. Each of the nylon polymers has a crystallinity of 25% or greater and a $T_m$ of 170° C. or greater. The thermal expansion coefficient (γ) of each of these polymers at 25° C. and within a range of $T_m$ to $T_m$ minus 10° C. is given in Table 1.

The semicrystalline polymer component of the composition may also comprise a polymer blend containing, in addition to the first polymer, 1%–20% by volume of a second semicrystalline polymer. Preferably, the second semicrystalline polymer comprises a polyolefin-based or polyester-based thermoplastic elastomer. The thermoplastic elastomer preferably has a $T_m$ in the range of 150° C. to 190° C. and a thermal expansion coefficient value at a temperature in the range $T_m$ to $T_m$ minus 10° C. that is at least five times greater than the thermal expansion coefficient value at 25° C. Suitable thermoplastic elastomers for forming a polymer blend with nylon-12 or nylon-11 are polyolefin-based or polyester-based and obtained from Advanced Elastomer Systems, Akron, Ohio and DuPont Engineering Polymers, Wilmington, Del., with the commercial names of Santoprene and Hytrel G-4074, respectively. The thermal expansion coefficients of each of these elastomers at 25° C. and within the range $T_m$ to $T_m$ minus 10° C. are listed in Table 1.

TABLE 1

| POLYMER* | Aesno-TL (Nylon-12) | Grilamid L20G (Nylon-12) | Santoprene [TPE† (poly-olefin-based] | Hytrel-G4074 [TPE† (poly-ester-based] |
|---|---|---|---|---|
| γ at 25° C. (cm/cm °C.) | $1.1 \times 10^{-4}$ | $1.2 \times 10^{-4}$ | $2.8 \times 10^{-4}$ | $1.8 \times 10^{-4}$ |
| γ near $T_m$** (cm/cm °C.) | $5.5 \times 10^{-4}$ | $4.9 \times 10^{-4}$ | $29.2 \times 10^{-4}$ | $30.9 \times 10^{-4}$ |

*Thermal Expansion Coefficients (γ) were measured with a Thermo Mechanical Analyzer.
**Within the range $T_m$ to $T_m$ minus 10° C.
†Thermoplastic Elastomer.

In the conductive polymeric composition, the particulate conductive filler may comprise carbon black, graphite, metal particles, or a combination of these. Metal particles may include, but are not limited to, nickel particles, silver flakes, or particles of tungsten, molybdenum, gold platinum, iron, aluminum, copper, tantalum, zinc, cobalt, chromium, lead, titanium, or tin alloys. Such metal fillers for use in conductive polymeric compositions are known in the art.

Preferably, the conductive particles comprise a highly conductive carbon black, such as Sterling SO N550, Vulcan XC-72, and Black Pearl 700 (all available from Cabot Corporation, Norcross, Ga.), all known in the art for their use in conductive polymeric compositions. A suitable carbon black, such as Sterling SO N550, has a particle size of about 0.05–0.08 microns, and a typical particle aggregate sphere size of 0.25–0.5 microns as determined by DiButyl Phthalate (DBP) absorption. The volume ratio of the particulate conductive filler to the polymer component ranges from 10:90 to 60:40, preferably 20:80 to 50:50, and more preferably 30:70 to 40:60.

In addition to the semicrystalline polymer component and the particulate conductive filler, the conductive polymeric composition may additionally comprise additives to enhance electrical and thermal stability. Suitable inorganic additives include metal oxides, such as magnesium oxide, zinc oxide, aluminum oxide, titanium oxide, or other materials, such as calcium carbonate, magnesium carbonate, alumina trihydrate, and magnesium hydroxide. Such inorganic additives may be present in the composition in an amount by weight of 1% to 10%, and more preferably from 2% to 8%. Organic antioxidants, preferably those having a melting point below the temperature at which the conductive polymeric composition is processed, may optionally be added to the composition to increase the thermal stability. Examples of such antioxidants include, but are not limited to, phenol or aromatic amine type heat stabilizers, such as N,N'-1,6-hexanediylbis(3,5-bis (1,1-dimethylethyl)-4-hydroxybenzene) propanamide (Irganox-1098, Ciba-Geigy Corp., Hawthorne, N.Y.), N-stearoyl-4-aminophenol and N-lauroyl-4-aminophenol. The proportion by weight of the organic antioxidant agent in the composition may range from 0.1% to 5%, preferably from 0.2% to 2%. The conductive polymeric composition may also comprise inert fillers, antiozonants, fire retardants, stabilizers, dispersing agents, crosslinking agents or other components, in various proportions as known in the art.

To enhance electrical stability, the conductive polymer composition may be crosslinked by chemicals, such as organic peroxide compounds, or by irradiation, such as by high energy electrons, ultraviolet radiation or by gamma radiation, as known in the art. Although crosslinking is dependent on the polymeric components and the application, normal crosslinking levels are equivalent to that achieved by an irradiation dose in the range of 2 to 50 Mrads, preferably 2.5 to 30 Mrads, e.g. 10 Mrads. If crosslinking is by irradiation, the composition may be crosslinked before or after attachment of the electrodes.

In an embodiment of the invention, the high temperature PTC device of the invention comprises a PTC "chip" 1 illustrated in FIG. 1 and electrical terminals 12 and 14, as described below and schematically illustrated in FIG. 2. As shown in FIG. 1, the PTC chip 1 comprises the conductive polymeric composition 2 of the invention sandwiched between metal electrodes 3. The electrodes 3 and the PTC composition 2 are preferably arranged so that the current flows through the PTC composition over an area L×W of the chip 1 that has a thickness, T, such that W/T is at least 2, preferably at least 5, especially at least 10. The electrical resistance of the chip or PTC device also depends on the thickness and the dimensions W, L, and T may be varied in order to achieve a preferable resistance, described below. For example, a typical PTC chip generally has a thickness of 0.05 to 5 millimeters (mm), preferably 0.1 to 2.0 mm, and more preferably 0.2 to 1.0 mm. The general shape of the chip/device may be that of the illustrated embodiment or may be of any shape with dimensions that achieve the preferred resistance.

It is generally preferred to use two planar electrodes of the same area which are placed opposite to each other on either side of a flat PTC polymeric composition of constant thickness. The material for the electrodes is not specially limited, and can be selected from silver, copper, nickel, aluminum, gold, and the like. The material can also be selected from combinations of these metals, e.g. nickel-plated copper, tin-plated copper, and the like.

Figure 2:
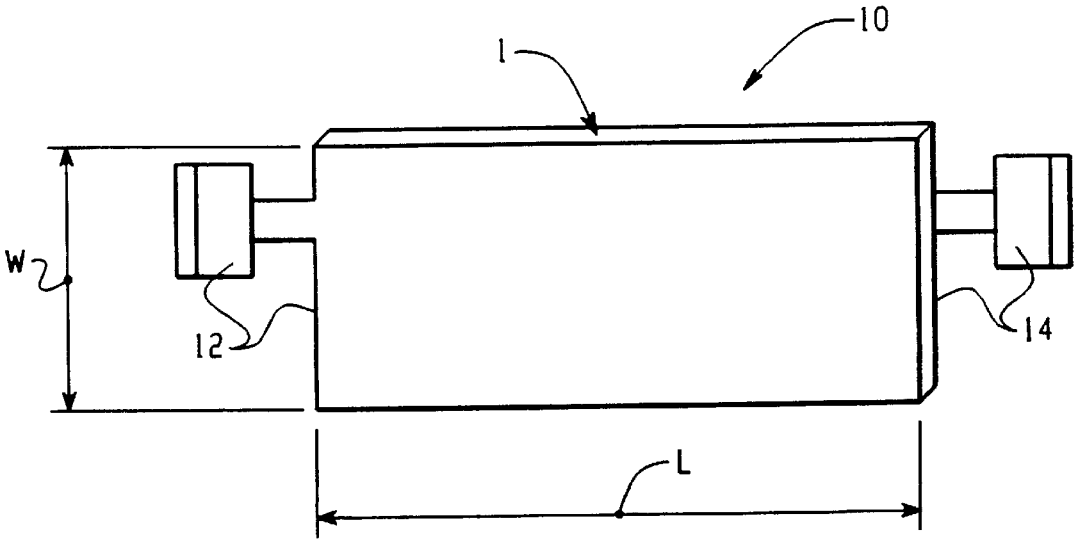
FIG. 2 is a schematic illustration of an embodiment of a PTC device according to the invention, comprising the PTC chip of FIG. 1 with two attached terminals.
Figure 4:
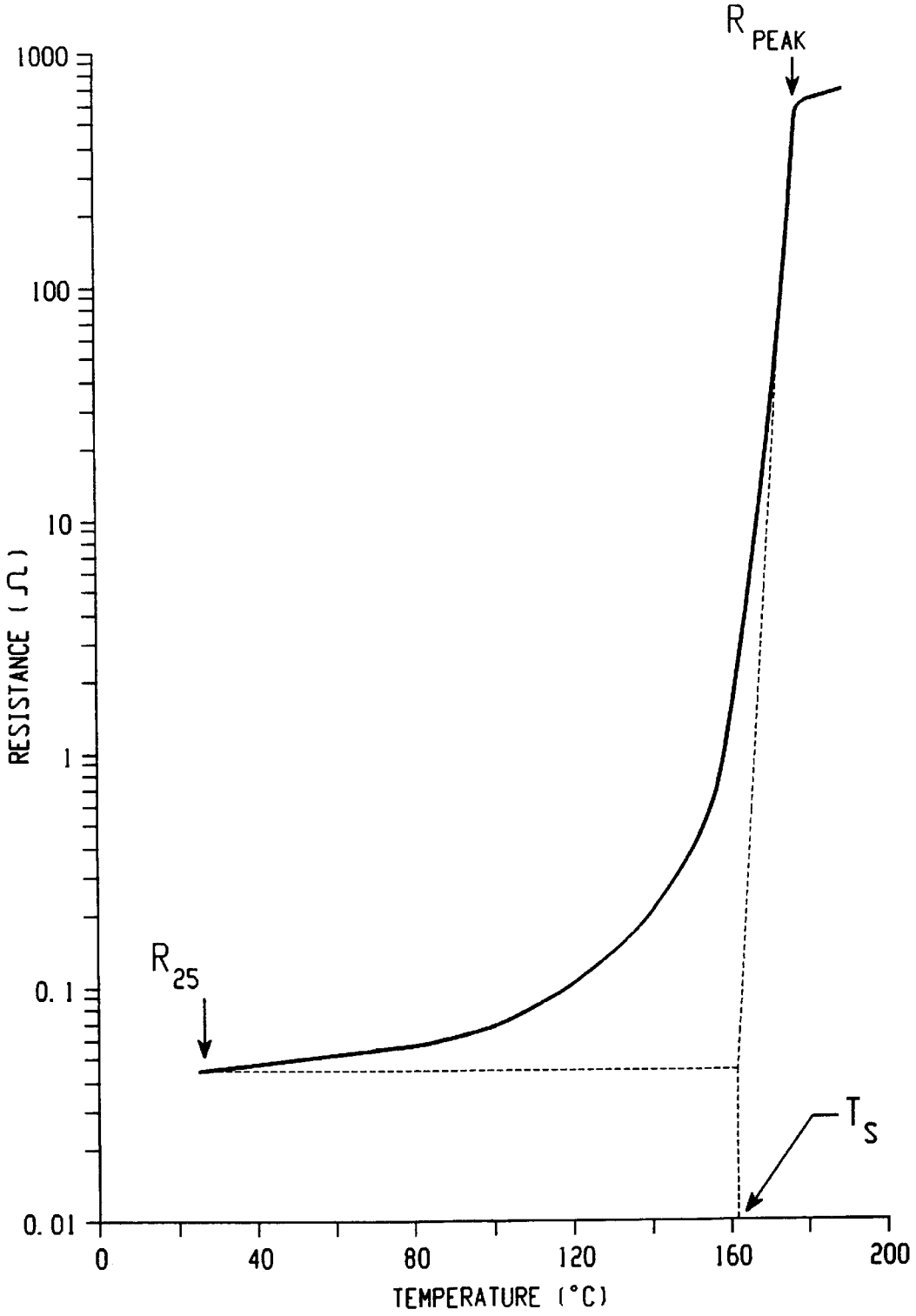
FIG. 4 is a graphic illustration of the PTC behavior of the device comprising the 35 volume % carbon black composition of Example 4, where $R_{peak}$ is the resistance at the peak of a resistance versus temperature curve and $R_{25}$ is the resistance at 25° C.

An embodiment of the PTC device 10 is illustrated in FIG. 2, with terminals 12 and 14 attached to the PTC chip illustrated in FIG. 1. When an AC or a DC current is passed through the PTC device, the device preferably demonstrates an initial resistance at 25° C. of 10–100 mΩ, and more preferably 15–75 mΩ. The ratio of the peak resistance ($R_{peak}$) of the PTC chip or device to the resistance of the chip/device at 25° C. ($R_{25}$) is at least $10^3$, preferably $10^4$ to $10^5$, where $R_{peak}$ is the resistance at the peak of a resistance versus temperature curve that plots resistance as a function of temperature, as illustrated in FIG. 4. The $T_s$ is shown as the temperature at the intersection point of extensions of the substantially straight portions of a plot of the log of the resistance of the PTC chip/device and the temperature which lies on either side of the portion showing the sharp change in slope.

The high temperature PTC device of the invention also demonstrates a resistance $R_{1000}$ at 25° C. that is less than three times, and preferably less than 2.5 times, a resistance $R_o$ where $R_o$ is the initial resistance at 25° C. and $R_{1000}$ is the resistance at 25° C. after 1000 temperature excursions (cycles) to the $T_s$ and back to 25° C. (See, for example, the data of Table 6). For a single cycle, the PTC device may also be capable of withstanding a voltage of up to 70 volts or more without failure. Preferably, the device withstands a voltage of at least 20 volts, and more preferably, at least 30 volts without failure.

The conductive polymeric compositions of the invention are prepared by methods known in the art. In general, the polymer or polymer blend, the conductive filler and additives (if appropriate) are compounded at a processing temperature that is at least 20° C. higher, but less than 40° C. higher, than the melting temperature of the polymer or polymer blend. After compounding, the homogeneous composition may be obtained in any form, such as pellets. The composition is then compression molded or extruded into a thin sheet, at a temperature similar to that used during compounding. Metallic electrodes, in the form of metal foil covering both the top and bottom of a layer of the polymer, are applied to the composition during the compression molding or extrusion process.

The pressure and processing time employed during compression molding or extrusion are variable and depend upon the composition. For example, the higher the filler content (e.g. carbon black), the higher is the pressure used, and the longer is the processing time. Compositions, such as those described below in the Examples, and containing nylon-12, carbon black, and magnesium oxide in varying proportions are compression molded at a pressure of 1 to 10 MPa, preferably 2 to 4 MPa, with a processing time of 5 to 60 minutes, preferably 10 to 30 minutes. By controlling the parameters of pressure and time, different sheets of various thicknesses may be obtained. The sheets are then cut to obtain PTC chips having predetermined dimensions and comprising the conductive polymeric composition sandwiched between the metal electrodes. The composition may be crosslinked by irradiation, if desired, prior to cutting of the sheets into PTC chips. The sheets from which the chips are cut are preferably of uniform thickness. Electrical terminals are then soldered to each individual chip to form PTC electrical devices.

The following examples illustrate embodiments of the conductive polymeric compositions and high temperature PTC devices of the invention. However, these embodiments are not intended to be limiting, as other methods of preparing the compositions and devices to achieve desired electrical and thermal properties may be determined by those skilled in the art. The compositions, PTC chips and PTC devices were tested for PTC properties directly by a resistance versus temperature (R-T) test and indirectly by a switching test, overvoltage test and cycle test, as described below. The number of samples tested from each batch of chips is indicated below and the results of the testing reported in the Tables are an average of the values for the samples.

The resistances of the PTC chips and devices were measured, using a four-wire standard method, with a Keithley 580 micro-ohmmeter (Keithley Instruments, Cleveland, Ohio) having an accuracy of ±0.01 mΩ. To determine an average resistance value at 25° C., the resistances of 20 to 30 chips and devices were measured for each PTC composition. The resistivity was calculated from the measured resistance and the geometric area and thickness of the chip.

To determine the resistance/resistivity behavior of the PTC devices versus the temperature (R-T test), three to four device samples were immersed in an oil bath having a constant heating rate of about 2° C. per minute. The temperature and the resistance/resistivity of each of the samples were measured simultaneously. Resistance and temperature were measured with a multimeter having an accuracy of ±0.1 mΩ and an RTD digital thermometer having an accuracy of ±0.01° C., respectively. The PTC effect was calculated by the value of $R_{peak}/R_{25}$.

The $T_s$ of the PTC composition comprising the PTC devices was determined by a constant voltage switching test, usually conducted by passage of a DC current through the device at, for example, 10 volts and 10 amperes (amps). Because of the self-heating caused by the high current, the device quickly reaches the $T_s$ and, with the voltage remaining constant, the current suddenly drops to a low value (OFF Current or trickle current) which can be used to determine the OFF state resistance of the device. The devices exhibit the desired PTC effect if they are capable of staying and stabilizing at the $T_s$ for at least 150 seconds at the specified condition (e.g. 10 volts and 10 amps). During this test, a computer automatically records the initial voltage, initial current, OFF current, the switching temperature and the switching time. The devices that "pass" the initial 10 volt/10 amps test are then subjected sequentially to switching tests at higher voltages, e.g. 15 volts/10 amps, 20 volts/10 amps, 30 volts/10 amps, 50 volts/10 amps, etc., until the device fails. Failure of the device is indicated if the device is incapable of stabilizing at the $T_s$ for 150 seconds or undergoes "thermal runaway". A sample size of three to four was used for this test.

The cycle test is performed in a manner similar to the switching test, except that the switching parameters (usually 10.5 volts and 15 amps) remain constant during a specified number of switching cycle excursions from 25° C. to the $T_s$ and back to 25° C. The resistance of the device is measured at 25° C. before and after specified cycles and the number of total cycles may be up to 1000 or more. The initial resistance at 25° C. is designated $R_o$ and the resistance after X numbers of cycles is designated $R_x$, e.g. $R_{1000}$. The cycle test sample size was generally five.

The overvoltage test was performed on eight to ten device samples using a variable voltage source to test the maximum voltage that the PTC device can withstand. The maximum withstood voltage is determined when a knee point ("knee voltage") appears in a power versus voltage curve.

PREPARATION OF NYLON-12/CARBON BLACK COMPOSITIONS

EXAMPLES 1–5

Nylon-12/carbon black compositions containing various volume percentages of nylon-12 and carbon black are illustrated in Table 2 as Examples 1–5. The compositions of each of the Examples were generally prepared according to the method described below for preparing the 35 volume % Carbon Black/65 volume % Nylon-12 composition. Variations from the described method for each Example are illustrated in the Table. Examples 1–5 contain volume ratios of nylon-12 (Aesno-TL) to carbon black of 80:20 (20 volume %), 75:25 (25 volume %), 70:30 (30 volume %), 65:35 (35 volume % or 35 vol %) and 60:40 (40 volume %).

Preparation of the 35 Volume % Carbon Black/65 Volume % Nylon-12 Composition To 197 parts by weight of nylon-12 (Aesno-TL) were added 172 parts by weight of carbon black (Sterling SO N550) and 13 parts by weight of magnesium oxide (Aldrich Chemical Co.). The corresponding volume fraction of nylon-12 to carbon black is 65/35, calculated by using a value for the compact density of the carbon black of 1.64 g/cm$^3$ and for the density of the Aesno-TL of 1.01 g/cm$^3$. After slight mechanical stirring, the crude mixture was mixed to homogeneity in a Brabender mixer at a temperature of 202°–205° C. The homogeneous mixture was then cooled and chopped into pellets.

The pelleted nylon-12/carbon black mixture was covered on both top and bottom layers with nickel-plated copper foil electrodes and compression molded at 3 MPa and 205° C. for 20 minutes. The thickness of the resulting molded sheet was typically about 0.4 mm to 0.5 mm. Chip samples of 2×1.1 cm$^2$ were cut from the sheets. Copper terminals were then soldered to each of the chip samples to form PTC devices. The compositions were not crosslinked.

Composition Evaluations, Examples 1–5

Figure 3:
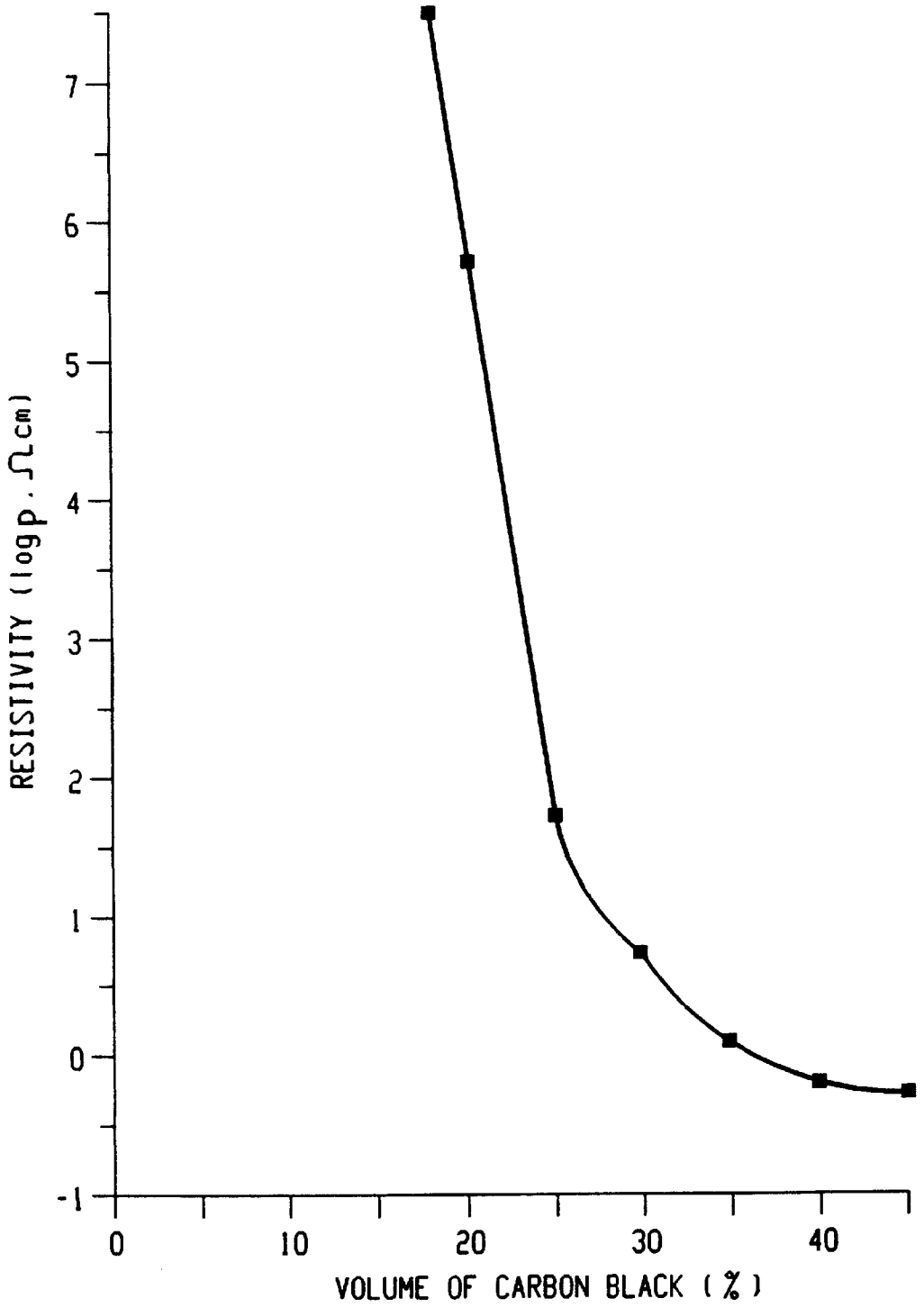
FIG. 3 is a graphic illustration of the resistivity of the PTC compositions of Examples 1–6, comprising nylon-12 and volume percentages of carbon black ranging from 20%–40%.

The resistivity at 25° C. of the PTC chips comprising the conductive nylon-12 compositions of Examples 1–5 was measured and are shown in Table 2 and graphically as a logarithmic plot in FIG. 3. The data show that compositions containing 25% to 40% carbon black by volume (75% to 60% nylon-12 by volume) exhibit an initial resistivity at 25° C. of less than 100 Ωcm and that compositions containing 30% to 40% carbon black by volume exhibit preferred initial resistivities of less than 10 Ωcm. The average resistance of the chips at 25° C. was also measured and chips comprising a composition containing 35% to 40% carbon black by volume exhibit preferred initial resistances of between 10 mΩ and 100 mΩ and more preferred resistances of 15 mΩ to 75 mΩ. For example, chips with the 35 volume % carbon black composition showed a resistance of 28.9 mΩ. When copper terminals were soldered to these chips to form PTC devices, the resistance of the devices at 25° C. increased to 50 mΩ to 75 mΩ.

TABLE 2

| Example No. | 1 | 2 | 3 | 4 | 5 |
|---|---|---|---|---|---|
| Volume % Carbon Black | 20% | 25% | 30% | 35% | 40% |
| Weight % Carbon Black | 28.9 | 35.2 | 41.0 | 46.6 | 52.0 |
| Carbon Black* (Sterling N550) | 98.4 | 123.1 | 147.6 | 172.2 | 196.8 |
| Nylon-12* (Aesno-TL) | 242.4 | 226.8 | 212.1 | 197.1 | 181.8 |
| Magnesium Oxide* | 12.1 | 12.4 | 12.8 | 13.1 | 13.5 |
| Molding Temperature (°C.) | 198 | 200 | 202 | 205 | 210 |
| Molding Pressure (MPa) | 2 | 2 | 2.5 | 3 | 3.5 |
| Molding Time (minutes) | 10 | 10 | 15 | 20 | 20 |
| Resistivity at 25° C. (Ωcm) | $4.44 \times 10^5$ | 49.9 | 5.25 | 1.25 | 0.664 |
| Average Chip Resistance** at 25° C. (mΩ) | $5.25 \times 10^6$ | 738 | 124 | 28.9 | 18.1 |

*Parts by Weight.
**Typical dimension is 2 × 1.1 cm$^2$ with thickness of about 0.4 mm.

EXAMPLES 6–9

The compositions of Examples 6–9 illustrated in Table 3 were prepared according to the method for Examples 1–5 except that the nylon-12 was Grilamid L20G. Examples 6–9 contain volume ratios of nylon-12 to carbon black of 70:30 (30 volume %), 67.5:32.5 (32.5 volume %), 65:35 (35 volume %) and 62:38 (38 volume %)

As shown in Table 3, the average chip resistivity at 25° C. for each of the compositions comprising Grilamid L20G was comparable to that of chips comprising the 30 to 40 volume % compositions of Examples 1–5, and each exhibited a preferred resistivity value of less than 10 Ωcm. The average chip resistance of the 30 and 32.5 volume % compositions, however, was high and could lead to a device resistance that would fall outside the preferred 15 mΩ to 75 mΩ range. Therefore, these compositions were not tested further. When terminals were attached to chips comprising the 35 and 38 volume % compositions to form PTC devices, the average resistance of the devices at 25° C. fell within the preferred range. These devices were capable of withstanding an average of 34 to 47 volts (knee voltage) during the overvoltage test without failure and were also capable of sustaining a $T_s$ for at least 150 seconds under an applied voltage of 25 to 30 volts and a current of 10 amps during the switching test, showing a high PTC effect.

TABLE 3

| Example No. | 6 | 7 | 8 | 9 |
|---|---|---|---|---|
| Volume % Carbon Black | 30% | 32.5% | 35% | 38% |
| Weight % Carbon Black | 41.0 | 43.9 | 46.6 | 49.9 |
| Carbon Black* (Sterling N550) | 98.4 | 106.1 | 114.8 | 124.6 |
| Nylon-12* (Grilamid L20G) | 141.4 | 136.4 | 131.3 | 125.2 |
| Magnesium Oxide* | 8.51 | 8.63 | 8.75 | 8.87 |
| Molding Temperature (°C.) | 200 | 200 | 205 | 205 |
| Molding Pressure (MPa) | 2.5 | 2.5 | 3 | 3 |
| Molding Time (minutes) | 15 | 15 | 20 | 20 |
| Resistivity at 25° C. (Ωcm) | 2.78 | 1.66 | 1.07 | 0.796 |
| Average Chip Resistance** at 25° C. (mΩ) | 65.51 | 37.50 | 19.79 | 17.24 |
| Average Device Resistance at 25° C. (mΩ) | ND*** | ND | 35.46 | 28.54 |
| Average Knee Voltage (volts) | ND | ND | 47 | 34 |
| Maximum Voltage For Switching Test (volts) | ND | ND | 30 | 25 |
| PTC Effect | ND | ND | $1.18 \times 10^4$ | $8.28 \times 10^3$ |

*Parts by Weight.
**Typical dimension is 2 × 1.1 cm$^2$ with thickness of about 0.4 mm.
***Not Done.

Figure 5:
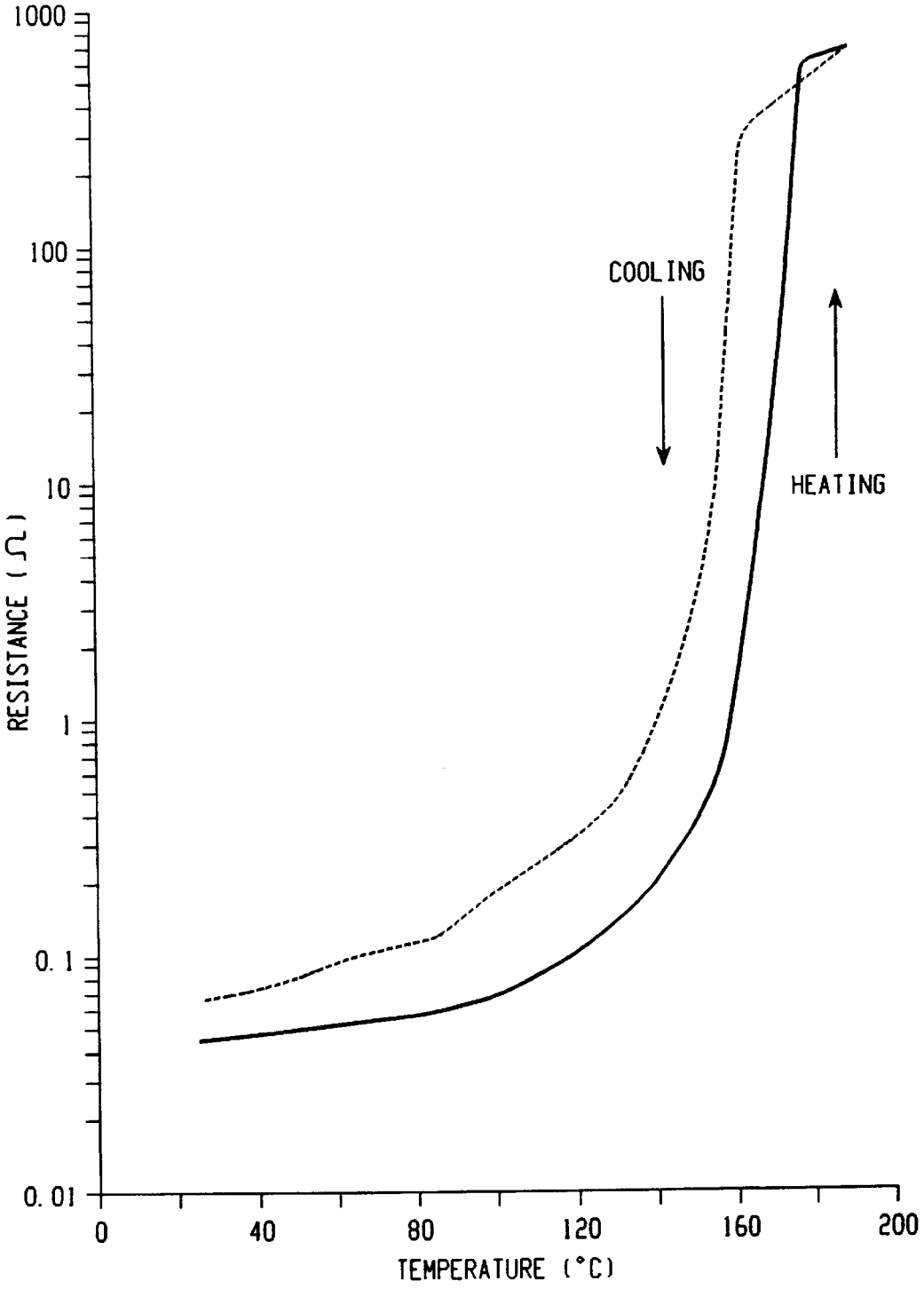
FIG. 5 is a graphic illustration of the switching test results for the PTC device comprising the uncrosslinked composition of Example 4 plotted as a resistance versus temperature curve.

Chips comprising the 35 volume % carbon black/65 volume % nylon-12 composition of Example 4 were selected for further testing. The PTC effect of the uncrosslinked composition was determined directly by an R-T test (FIGS. 4 and 5). As illustrated, the $T_s$ of the composition is 161.3° C. and shows a PTC effect of $1.58 \times 10^4$. The reversibility of the PTC effect is illustrated, although the level of the resistance at 25° C. does not return to the initial level. As discussed below in Example 10, crosslinking of the composition improved this "ratcheting" effect.

Because of the demonstrated high PTC effect of the composition of Example 4, a device comprising the composition can withstand a voltage of as high as 50 volts and a current of as high as 35 amps during the switching test and the overvoltage test reported in Tables 4 and 6. The device demonstrates a low average resistance of 59.3 mΩ at 25° C. (Table 6).

The data of Table 4 illustrate the results of a switching test performed for the uncrosslinked 35 volume % composition of Example 4 for various voltages applied at 25° C. Both the $T_s$ and the ratio of resistances ($R_T/R_O$) increased with the increase of voltage applied. This indicates that, because of the high PTC effect, the material can withstand high voltage. As the voltage was increased to 50 volts, the $R_T/R_O$ increased to 4 orders of magnitude with a stable $T_s$ of 164.5° C. The composition was then tested for switching properties at various ambient temperatures, as illustrated in Table 5. The results demonstrate acceptable switching properties under 25 volts and 10 amps at ambient temperatures ranging from −40° C. to 50° C.

TABLE 4

Switching Test Results for the Uncrosslinked 35 vol % Carbon Black/65 vol % Nylon-12 Composition at 25° C.

| Test No. | Voltage Applied (V) | Current (A) ON | Current (A) OFF | Off Resistance (Ω)* | Ratio of Resistance ($R_T/R_O$)** | $T_s$ (°C.)*** |
|---|---|---|---|---|---|---|
| 1 | 5 | 5 | 0.85 | 5.88 | 113.1 | 149.5 |
| 2 | 10 | 5 | 0.44 | 22.73 | 437.1 | 158.5 |
| 3 | 12.5 | 10 | 0.35 | 35.71 | 686.8 | 159.2 |
| 4 | 15 | 10 | 0.33 | 45.45 | 874.1 | 159.5 |
| 5 | 17.5 | 10 | 0.27 | 64.81 | $1.248 \times 10^3$ | 159.8 |
| 6 | 20 | 10 | 0.23 | 86.96 | $1.672 \times 10^3$ | 160.2 |
| 7 | 30 | 10 | 0.16 | 187.5 | $3.606 \times 10^3$ | 161.1 |
| 8 | 30 | 20 | 0.14 | 214.3 | $4.121 \times 10^3$ | 161.3 |
| 9 | 50 | 10 | 0.09 | 555.6 | $1.068 \times 10^4$ | 164.5 |
| 10 | 50 | 20 | 0.09 | 555.6 | $1.068 \times 10^4$ | 165.2 |
| 11 | 50 | 35 | 0.09 | 625.0 | $1.202 \times 10^4$ | 165.5 |

*Initial Resistance 0.0520Ω.
**$R_T$ denotes the resistance at $T_s$; $R_O$ denotes the initial resistance at 25° C.
***During the switching test, the sample stayed and was stabilized at $T_s$ for at least 150 seconds.

TABLE 5

Switching Properties Versus Testing Temperature for the Uncrosslinked 35 vol % Carbon Black/65 vol % Nylon-12 Composition†

| Test No. | Testing Temperature (°C.) | Off Current (A) | Off Resistance (Ω)* | Ratio of Resistance ($R_T/R_O$)** | $T_s$ (°C.)*** |
|---|---|---|---|---|---|
| 1 | −40 | 0.26 | 96.2 | $2.16 \times 10^3$ | 161.3 |
| 2 | 0 | 0.21 | 119.1 | $2.68 \times 10^3$ | 163.1 |
| 3 | 15 | 0.20 | 125.0 | $2.81 \times 10^3$ | 164.8 |
| 4 | 50 | 0.15 | 166.7 | $3.75 \times 10^3$ | 167.1 |

†The switching test was conducted under 25 volts and 10 amperes.
*Initial Resistance 0.044Ω.
**$R_T$ denotes the Off Resistance; $R_O$ denotes the Initial Resistance.
***During the test, the sample stayed and stabilized at $T_s$ for at least 150 seconds.

EXAMPLES 10–13

Figure 6:
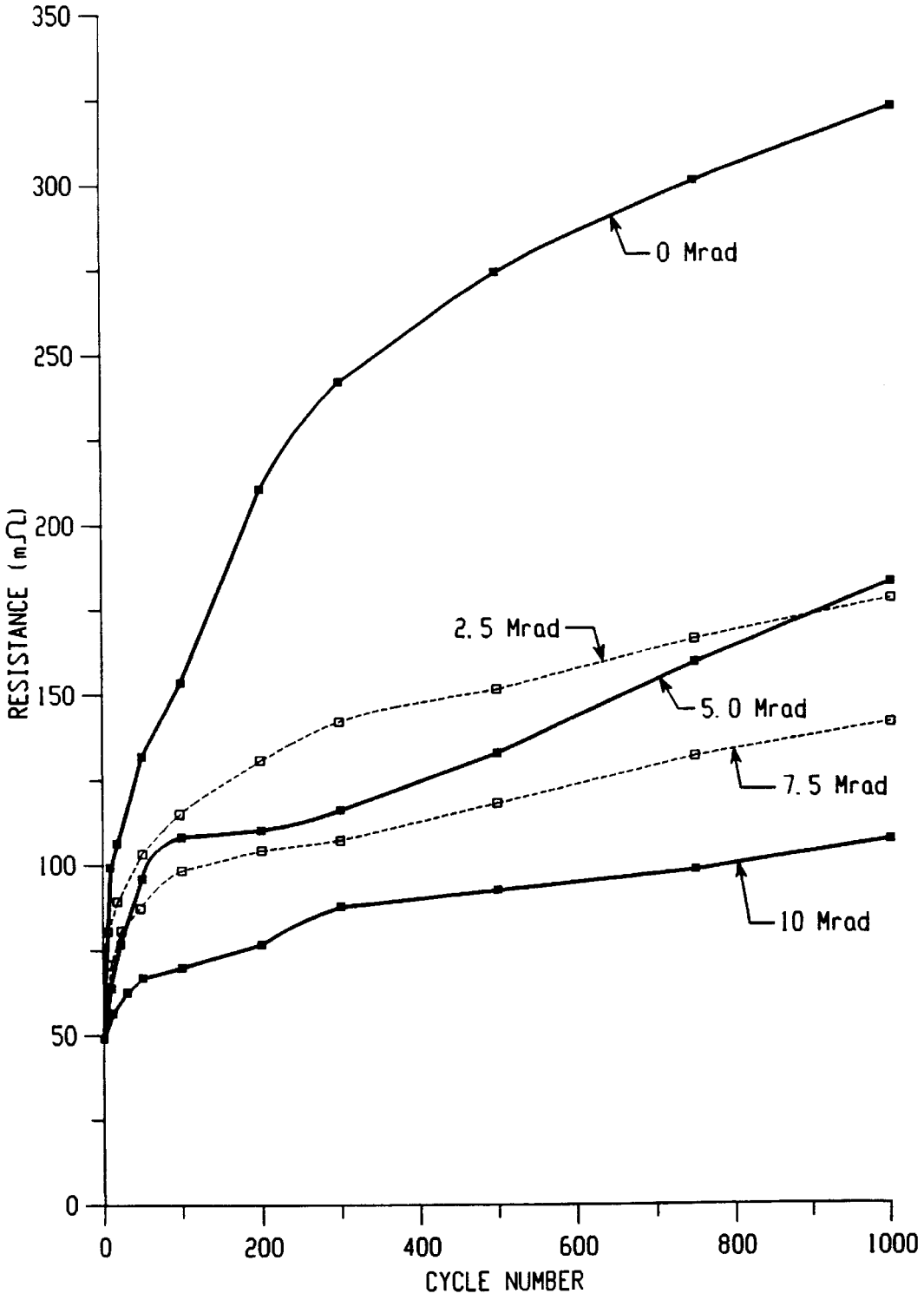
FIG. 6 is a graphic illustration of the effects of various doses of gamma irradiation on the device resistance at 25° C. of the composition of Example 4 (see Examples 10–13) after the indicated number of cycles, where each cycle represents an excursion from 25° C. to the $T_s$ and back to 25° C.
Figure 7:
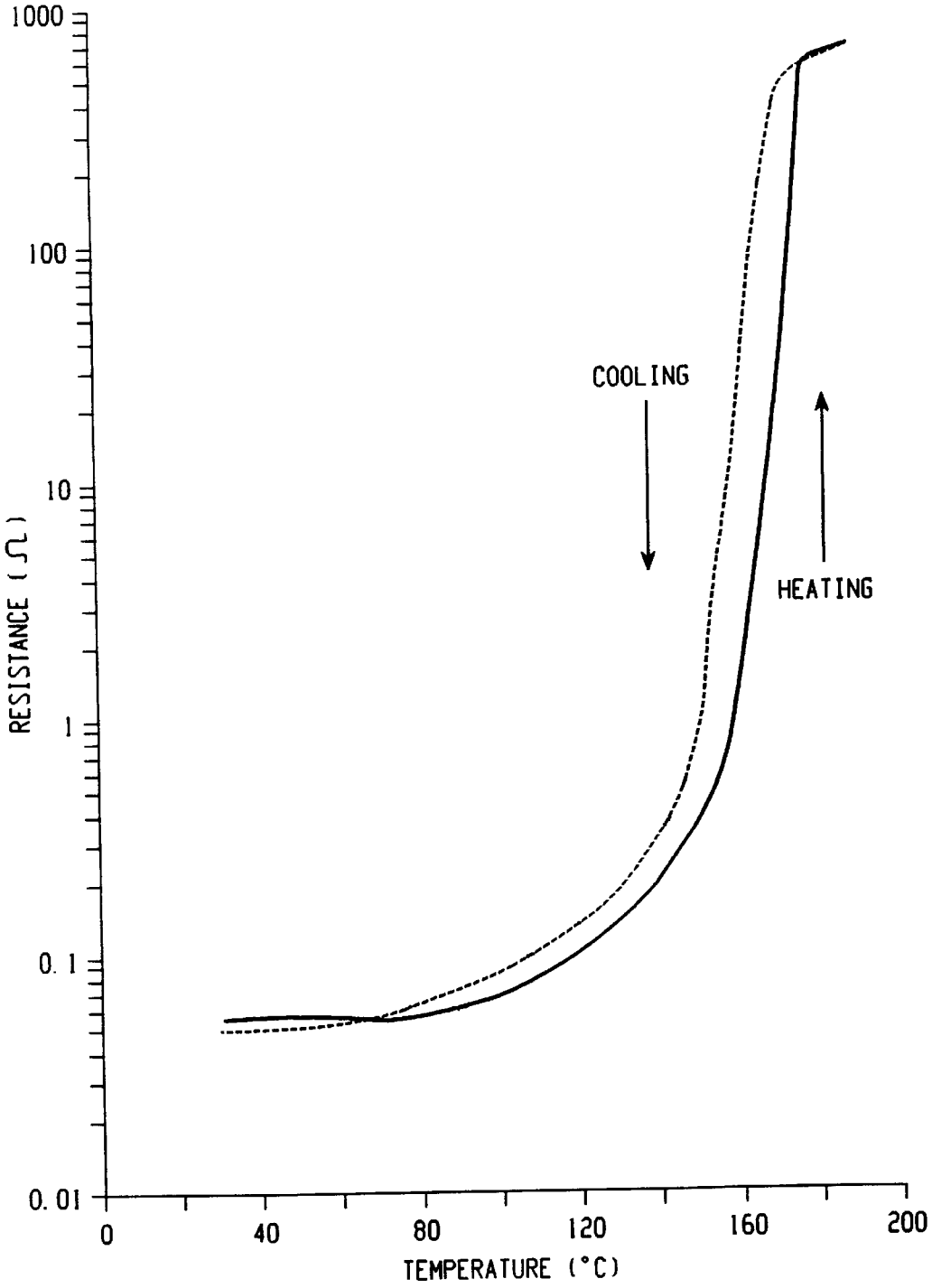
FIG. 7 is a graphic illustration of the switching test results for the PTC device comprising the composition of Example 4 after 10 Mrads of gamma irradiation (see Example 13).

A composition containing a 35 volume % of carbon black/65 volume % nylon-12 (Aesno-TL) was prepared according to the method of Example 4, except that prior to attachment of the terminals, the chips were irradiated with various doses of gamma irradiation from a Cobalt-60 source. Terminals were then attached to the irradiated chips and the resulting PTC devices were subjected to a cycle test comprising 1000 cycles. As illustrated in FIG. 6, an irradiation dose of 2.5, 5, 7.5 or 10 Mrads (Examples 10, 11, 12 and 13, respectively) improved the resistance stability at 25° C. of the devices after cycling compared to that of devices of Example 4 that were not irradiated. The reversible PTC effect of the composition irradiated with 10 Mrads is illustrated in FIG. 7.

A comparison of the properties of devices prepared according to Example 4 (unirradiated) and Examples 10–13 (irradiated) are reported in Table 6. It can be seen that after the irradiation, the PTC effect was slightly decreased, but the electrical stability was greatly enhanced, as evidenced by the significantly lowered increase in the electrical resistance of the device at 25° C. after up to 1000 cycles.

EXAMPLES 14–16

A composition containing a 35 volume % of carbon black/65% volume % nylon-12 (Aesno-TL) was prepared according to the method of Example 4, except that an antioxidant (Irganox 1098) was added to the composition during compounding. The data of Table 7 illustrate that the addition of the antioxidant did not substantially affect the chip or device resistance at 25° C. However, a small amount of added antioxidant (Example 14) substantially increased the PTC effect and the ability of the device to withstand a high voltage (76.7 volts).

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

TABLE 6

Summary of the R-T Test, Overvoltage Test and Cycle Test Results for the 35 Vol %* Carbon Black/65 Vol % Nylon-12 Composition Exposed to Different Levels of Irradiation

| Irradiation Level (Mrad) | Average Device Resistance (mΩ) at 25° C. | R-T test* Typical PTC Effect ($R_{peak}/R_{25}$) | Overvoltage Test Average Knee Voltage (volts) | PTC Switching Cycle Test** Times Resistance Increase After 1000 Cycles [$(R_{1000}-R_O)/R_O$] |
|---|---|---|---|---|
| 0 | 59.3 | $1.58 \times 10^4$ | 51.3 | 4.54 |
| 2.5 | 44.0 | $1.18 \times 10^4$ | 48.9 | 2.71 |
| 5.0 | 38.8 | $8.30 \times 10^3$ | 45.5 | 2.17 |
| 7.5 | 45.5 | $7.47 \times 10^3$ | 38.5 | 1.83 |
| 10.0 | 49.2 | $1.21 \times 10^4$ | 47.3 | 1.10 |

*$R_{peak}$ denotes the resistance of the PTC device at the peak of the R-T curve; $R_{25}$ denotes the resistance of the device at 25° C.
**The switching cycle test was conducted under 10.5 volts and 15 amps. $R_{1000}$ denotes the resistance of the PTC device at 25° C. after 1000 cycles of the switching test; $R_O$ denotes the initial resistance of the device at 25° C.

TABLE 7

| Example No. | 4 | 14 | 15 | 16 |
|---|---|---|---|---|
| Volume % Carbon Black | 35% | 35% | 35% | 35% |
| Weight % Carbon Black | 46.6 | 46.6 | 46.6 | 46.6 |
| Carbon Black* (Sterling N550) | 114.8 | 114.8 | 114.8 | 114.8 |
| Nylon-12* (Aesno-TL) | 131.4 | 131.4 | 131.4 | 131.4 |
| Magnesium Oxide* | 8.7 | 8.7 | 8.7 | 8.7 |

TABLE 7-continued

| Example No. | 4 | 14 | 15 | 16 |
|---|---|---|---|---|
| Irganox 1098* | 0 | 1.27 | 4.46 | 7.65 |
| Molding Temperature (°C.) | 205 | 202 | 200 | 200 |
| Molding Pressure (MPa) | 3 | 2.7 | 2.7 | 2.5 |
| Molding Time (minutes) | 20 | 18 | 15 | 115 |
| Average Chip Resistance** at 25° C. (mΩ) | 28.9 | 29.1 | 28.8 | 28.9 |
| Average Device Resistance at 25° C. (mΩ) | 59.3 | 58.9 | 51.78 | 47.46 |
| Average Knee Voltage (volts) | 51.3 | 76.7 | 22.0 | 24.8 |
| PTC Effect | $1.58 \times 10^4$ | $2.36 \times 10^4$ | $3.17 \times 10^3$ | $5.27 \times 10^3$ |

*Parts by Weight.
**Typical dimension is 2 × 1.1 $cm^2$ with thickness of about 0.4 mm.

I claim:

1. A conductive polymeric composition which exhibits PTC behavior, comprising:

(a) a semicrystalline polymer component that includes nylon 12; and (b) a particulate conductive filler;

said composition having a resistivity at 25° C. of 100 Ωcm or less and a resistivity at a $T_s$ greater than 125° C. that is at least $10^3$ times the resistivity at 25° C.

2. A polymeric composition according to claim 1, wherein the resistivity at 25° C. is 10 Ωcm or less.

3. A polymeric composition according to claim 1, wherein the composition has a resistivity at a $T_s$ which falls between 140° C. and 200° C. that is at least $10^3$ times the resistivity at 25° C.

4. A polymeric composition according to claim 3, wherein the $T_s$ falls between 150° C. and 190° C.

5. A polymeric composition according to claim 1, wherein the volume ratio of the particulate conductive filler to the polymer component ranges from 10:90 to 60:40.

6. A polymeric composition according to claim 5, wherein the volume ratio of the particulate conductive filler to the polymer component ranges from 20:80 to 50:50.

7. A polymeric composition according to claim 6, wherein the volume ratio of the particulate conductive filler to the polymer component ranges from 30:70 to 40:60.

8. A polymeric composition according to claim 1, wherein the particulate conductive filler is selected from carbon black, graphite, metal particles, and mixtures thereof.

9. A polymeric composition according to claim 1, wherein the polymer component has a melting temperature $T_m$ of 150°–200° C.

10. A polymeric composition according to claim 9, wherein the $T_m$ is 160°–195° C.

11. A polymeric composition according to claim 9, wherein the polymer component has a thermal expansion coefficient value at a temperature in the range $T_m$ to $T_m$ minus 10° C. that is at least three times greater than the thermal expansion coefficient value at 25° C.

12. A polymeric composition according to claim 1, wherein the polymer component has 20–70% crystallinity.

13. A polymeric composition according to claim 12, wherein the polymer component has 25–60% crystallinity.

14. A polymeric composition according to claim 1, wherein the semicrystalline polymer component comprises a polymer blend containing 1%–20% by volume of a second semicrystalline polymer.

15. A polymeric composition according to claim 14, wherein the second polymer has a melting temperature $T_m$ of 150° C. to 190° C.

16. A polymeric composition according to claim 14, wherein the second polymer has a thermal expansion coefficient value at a temperature in the range $T_m$ to $T_m$ minus 10° C. that is at least five times greater than the thermal expansion coefficient value at 25° C.

17. A polymeric composition according to claim 14, wherein the second polymer is selected from a polyolefin-based or polyester-based thermoplastic elastomer, and mixtures thereof.

18. A polymeric composition according to claim 1, wherein the polymeric composition is crosslinked with the aid of a chemical agent or by irradiation.

19. An electrical device which exhibits PTC behavior, comprising:

(a) a conductive polymeric composition which exhibits PTC behavior and which comprises (i) a semicrystalline polymer component that includes nylon-12 (ii) a particulate conductive filler, said composition having a resistivity at 25° C. of 100 Ωcm or less, and further having a resistivity at a $T_s$ greater than 125° C. that is at least $10^3$ times the resistivity at 25° C.; and (b) at least two electrodes which are in electrical contact with the conductive polymeric composition to allow a DC current to pass through the conductive polymeric composition under an applied voltage.

20. A device according to claim 19, wherein the $T_s$ falls between 150° C. and 190° C.

21. A device according to claim 19, wherein the resistivity of the polymeric composition at 25° C. is 10 Ωcm or less.

22. A device according to claim 19, wherein the device has a resistance of 10–100 mΩ at 25° C.

23. A device according to claim 19, wherein the device has a resistance of 15–75 mΩ at 25° C.

24. A device according to claim 19, wherein the applied voltage is at least 20 volts.

25. A device according to claim 24, wherein the applied voltage is at least 30 volts.

26. A device according to claim 19, wherein the volume ratio of the particulate conductive filler to the polymer component ranges from 10:90 to 60:40.

27. A device according to claim 26, wherein the volume ratio of the particulate conductive filler to the polymer component ranges from 20:80 to 50:50.

28. A device according to claim 27, wherein the volume ratio of the particulate conductive filler to the polymer component ranges from 30:70 to 40:60.

29. A device according to claim 19, wherein the particulate conductive filler is selected from carbon black, graphite, metal particles, and mixtures thereof.

30. A device according to claim 19, wherein the polymer component has a melting temperature $T_m$ of 150°–200° C.

31. A device according to claim 30, wherein the melting temperature is 160°–195° C.

32. A device according to claim 19, wherein the polymer component has a thermal expansion coefficient value at a temperature in the range $T_m$ minus 10° C. that is at least three times greater than the thermal expansion coefficient value at 25° C.

33. A device according to claim 19, wherein the polymer component has 20–70% crystallinity.

34. A device according to claim 33, wherein the polymer component has 25–60% crystallinity.

35. A device according to claim 19, wherein the semicrystalline polymer component comprises a polymer blend containing 1%–20% by volume of a second semicrystalline polymer.

36. A device according to claim 35, wherein the second polymer is selected from a polyolefin-based or polyester-based thermoplastic elastomer, and mixtures thereof.

37. A device according to claim 19, wherein the conductive polymeric composition has been crosslinked with the aid of a chemical agent or by irradiation.

38. A device according to claim 19, wherein the device has as ratio of $R_{peak}$ to $R_{25}$ of at least $10^3$, where $R_{peak}$ is the resistance of the device at the peak of a resistance versus temperature curve, and $R_{25}$ is the resistance of the device at 25° C.

39. A device according to claim 19, wherein the device has an initial resistance $R_o$ at 25° C. and a resistance $R_{1000}$ at 25° C. after 1000 cycles to the $T_s$ and back to 25° C., and the resistance $R_{1000}$ is less than three times the $R_o$.

40. A conductive polymeric composition which exhibits PTC behavior, comprising:

(a) a semicrystalline polymer component consisting essentially of nylon 12; and (b) a particulate conductive filler;

said composition having a resistivity at 25° C. of 100 Ωcm or less.

41. A conductive polymeric composition which exhibits PTC behavior, comprising:

(a) a semicrystalline polymer component consisting essentially of nylon 12; and (b) a particulate conductive filler;

said composition having a resistivity at 25° C. of 100 Ωcm or less and a resistivity at a $T_s$ greater than 125° C. that is at least $10^3$ times the resistivity at 25° C.

42. An electrical device which exhibits PTC behavior, comprising:

(a) a conductive polymeric composition which exhibits PTC behavior and which comprises (i) a semicrystalline polymer component consisting essentially of nylon-12 and (ii) a particulate conductive filler, said composition having a resistivity at 25° C. of 100 Ωcm or less; and (b) at least two electrodes which are in electrical contact with the conductive polymeric composition to allow a DC current to pass through the conductive polymeric composition under an applied voltage.

43. An electrical device which exhibits PTC behavior, comprising:

(a) a conductive polymeric composition which exhibits PTC behavior and which comprises (i) a semicrystalline polymer component consisting essentially of nylon-12 and (ii) a particulate conductive filler, said composition having a resistivity at 25° C. of 100 Ωcm or less and a resistivity at a $T_s$ greater than 125° C. that is at least $10^3$ times the resistivity at 25° C.; and (b) at least two electrodes which are in electrical contact with the conductive polymeric composition to allow a DC current to pass through the conductive polymeric composition under an applied voltage.

* * * * *